United States Patent [19]

Clyde et al.

[11] 4,395,620

[45] Jul. 26, 1983

[54] ELECTRIC STORAGE HEATING APPARATUS

[76] Inventors: Robert A. Clyde; William B. Crandall, both of Ashville Ter. Apt. 43, Ashville, N.C. 28805

[21] Appl. No.: 237,573

[22] Filed: Feb. 23, 1981

[51] Int. Cl.[3] ..... F24H 7/00; H05B 3/00

[52] U.S. Cl. ..... 219/378; 338/302

[58] Field of Search ..... 219/378, 365, 546; 338/302

[56] References Cited

U.S. PATENT DOCUMENTS

| | | | |
|---|---|---|---|
| 1,648,871 | 11/1927 | Whittingham | 338/302 |
| 1,935,163 | 11/1933 | Parsons | 338/302 X |
| 2,694,765 | 11/1954 | Hynes | 219/546 X |
| 3,381,113 | 4/1968 | Jacques et al. | 219/378 |
| 4,234,782 | 11/1980 | Barabas et al. | 219/378 X |

*Primary Examiner*—Roy N. Envall, Jr.
*Attorney, Agent, or Firm*—D. I. Hague

[57] ABSTRACT

An electric heat storage apparatus comprises an electric heating element, a ceramic heat storage pipe, an air passageway in communication with the pipe, and a thermostatically controlled air circulation means. The ceramic pipe has a scalloped-shaped outer surface providing a plurality of crests and troughs and a series of parallel grooves cut in at least some of the crests. The heating element is located in the grooves in contact with the pipe. In a preferred embodiment, the pipe is provided with a plurality of internal ribs of at least two different lengths. The pipe is supported on a ceramic cradle and a ceramic sponge or metal turnings are inserted into the pipe between the ribs to increase the heat transfer area.

18 Claims, 6 Drawing Figures

FIG. 2b
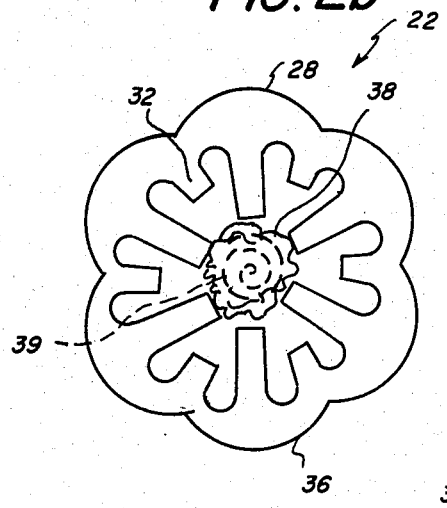
FIG. 2a
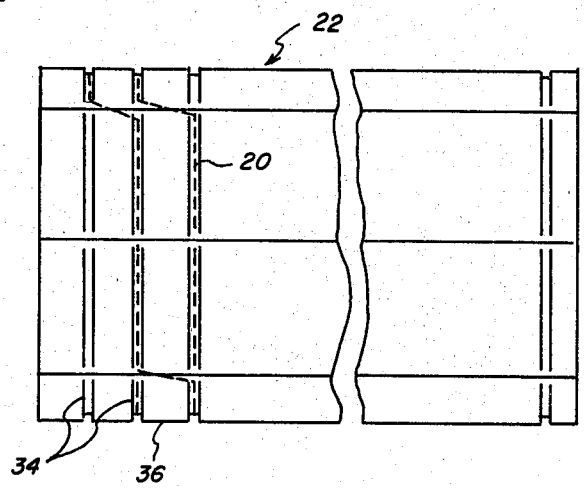
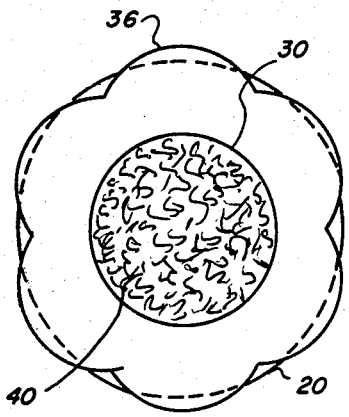
FIG. 3b
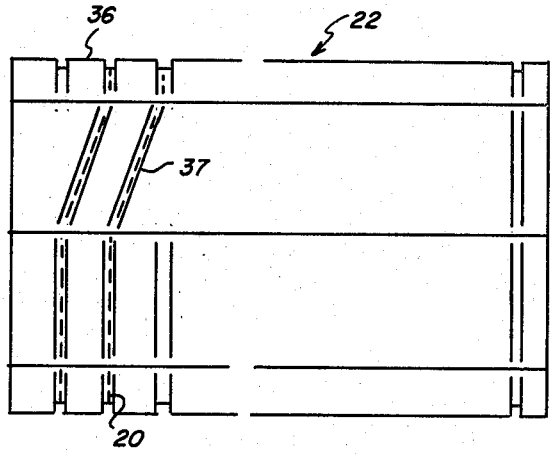
FIG. 3a

ELECTRIC STORAGE HEATING APPARATUS

CROSS REFERENCE TO RELATED APPLICATIONS

Reference is made to U.S. Pat. Application Ser. No. 937,085 filed Aug. 28, 1978 in the names of Robert A. Clyde and William B. Crandall now U.S. Pat. No. 4,251,239 issued Feb. 17, 1981.

FIELD OF THE INVENTION

This invention relates to heating apparatus and, more particularly to electric storage heating apparatus.

BACKGROUND OF THE INVENTION

The Electric Power Research Institute has predicted a shortage of electricity in the future. Spurred by the predicted energy crises and the prospect of a large capital investment necessary to meet customer peak load requirements, more and more electric utility companies are offering reduced rates for "off-peak" power, when the demand for electricity is much lower. To take advantage of these off-peak rates, electric storage heaters have been developed that convert electrical energy, during off-peak hours, into heat. The heat generated is stored internally in the heater for circulation by thermostatically controlled fans during peak rate time periods.

The Control Electric Corp. of Burlington, Vt., sells an electric storage heater for home use which consists of a resistance heating wire surrounded by an air input-output passage which in turn is surrounded by a ceramic brick heat storage core. The electrical energy flowing through the wire heats the wire. The heat from the wire is transferred to the air which in turn transfers the heat to the ceramic bricks. The heat transfer efficiency from the wire to the air, from the air to the ceramic bricks and again from the bricks to the air is poor.

Heat transfer efficiency of electric storage heaters could be improved (1) if the ceramic core contacted by the wire, and (2) if the ceramic core had a large surface area (much larger than the area contacted by the wire). One proposal to increase the heat transfer efficiency is to wind the heating wire around a circular ceramic pipe by providing spiral grooves in the ceramic. However, this proposal suffers several disadvantages. One disadvantage is that the cutting of spiral grooves around the outside of the ceramic involves a sophisticated operation because the ceramic pipe must be rotated and moved lengthwise at precisely the right speed so that the grooves will connect. Furthermore, if the pipe is cut while it is soft (before it if fired), the pipe tends to deform as it is pushed and turned. On the other hand if the pipe is cut after it is fired, cutting is difficult and may require expensive diamond cutting tools. A second disadvantage is that a circular pipe of ceramic tends to deform during its manufacture, (1) when the ceramic pipe is extruded horizontally onto a moving belt because the soft pipe contacts the belt at only one point, and (2) when the soft pipe is cut into individual heat storage cores. When grooves are cut in a deformed pipe, the grooves will be deeper in some pipe portions increasing the chance of core breakage.

SUMMARY OF THE INVENTION

The present invention provides an electric, ceramic, heat storage apparatus with improved heat transfer efficiency. The improved heat transfer efficiency is achieved in accordance with the teachings of the present invention by using a heat storage core made of ceramic pipe and having a scalloped-shaped outer surface providing a plurality of crests and troughs. A series of parallel grooves are cut in at least some of the crests and the heating element is located in the grooves in contact with the ceramic pipe. In a preferred embodiment of the invention, the ceramic pipe has a plurality of internal ribs of at least two different lengths. The pipe is supported on a ceramic cradle and a ceramic sponge or metal turnings are inserted between the ribs. This configuration of the heat storage core provides a number of advantages. (1) When the pipe is extruded onto a moving belt during its manufacture, the scallop-shaped outer surface contacts the pipe at two points and does not deform. (2) Parallel grooves can be cut in the crests of the scallops in a simple operation. The heating element, for example, a continuous length of resistance wire can be wound in the grooves with the troughs of the scallops providing cross-over connections from one groove to another groove. Alternatively, parallel grooves can be cut in all the crests except one, with slanting grooves connecting adjacent parallel grooves cut in the remaining crest. (3) The scallop shape allows the depth of the grooves to be increased at the wide pipe diameter which contains the grooves. (4) The internal ribs and metal or ceramic insert in combination provides an extended heat transfer surface area on the inside of the pipe. (5) The ceramic cradle provides a large heat storge capability.

The invention and its features and advantages will become more apparent by referring to the accompanying drawings and to the ensuing detailed description of the preferred embodiment.

BRIEF DESCRIPTION OF THE DRAWINGS

FIG. 2A is a plan view of the heat storage core shown in FIG. 1;

FIG. 2B is an end view of the heat storage core; and

FIGS. 3A and 3B are, respectively, a plan view and an end view of an alternative embodiment of the heat storage core.

DETAILED DESCRIPTION OF THE PREFERRED EMBODIMENTS

Because electric storage heaters are known in the art, the present description will be directed in particular to those elements forming part of or cooperating more directly with, apparatus in accordance with the present invention. It is to be understood that heater elements not specifically shown or described may take various forms well known to those having skill in the art.

Figure 1A:
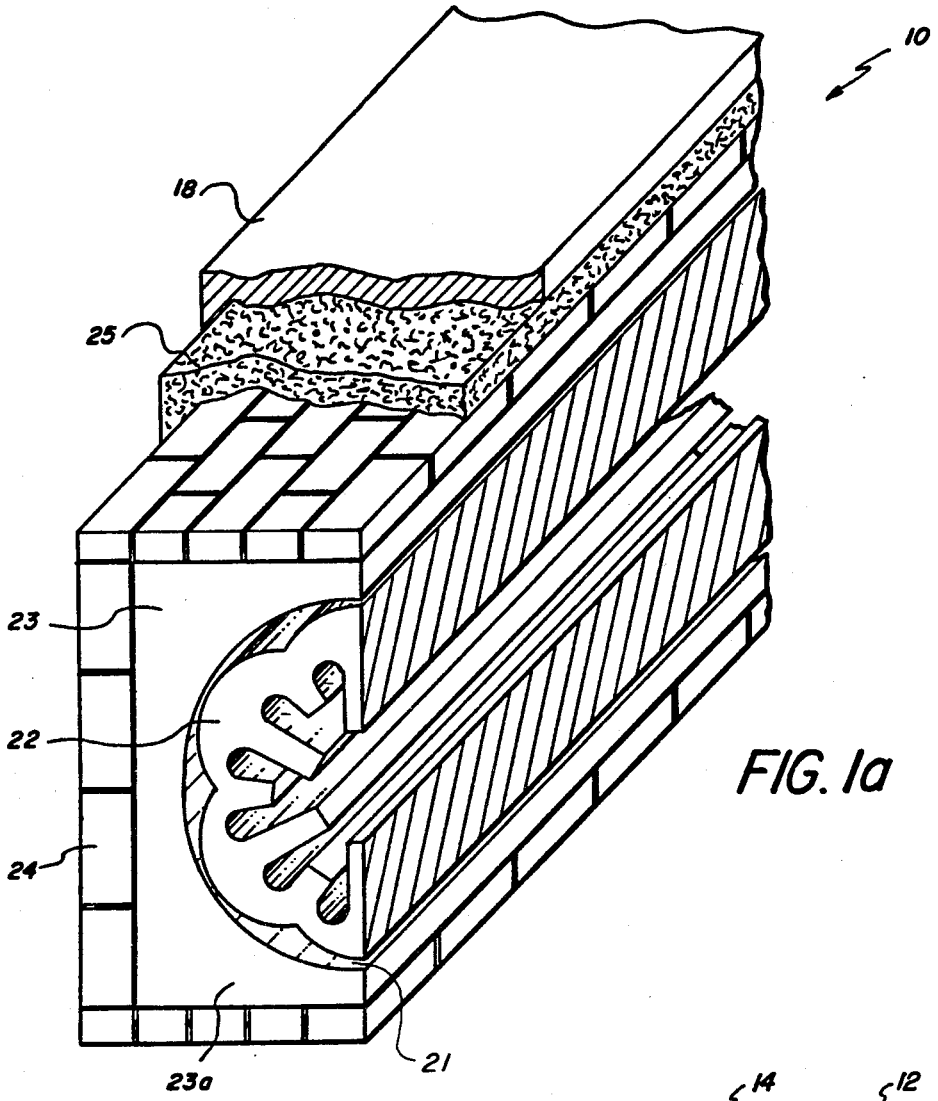
FIGS. 1*a* and 1*b* are, respectively, a perspective view and a sectional view of an electric storage heating apparatus according to the invention.
Figure 1B:
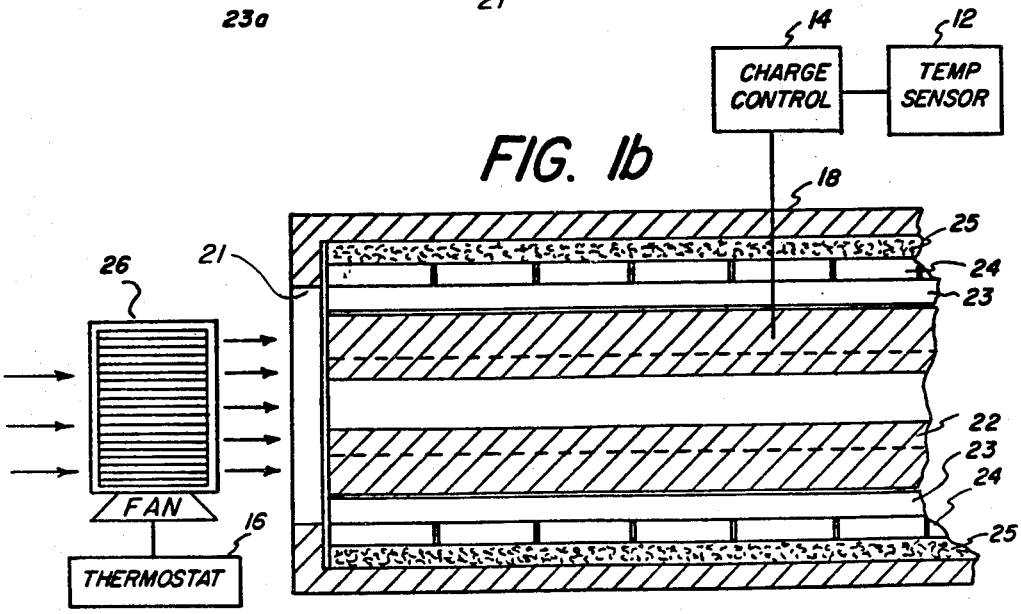
Figure 1A:
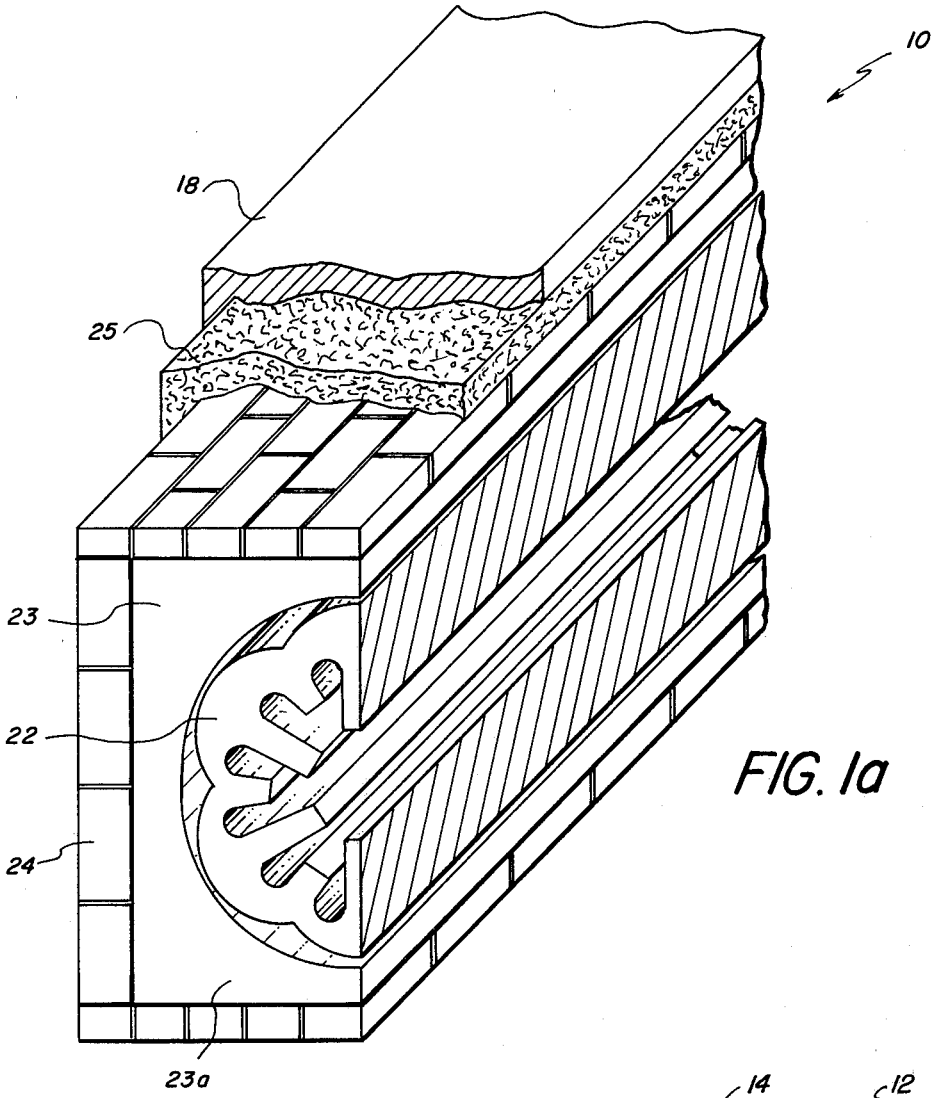
Figure 1B:
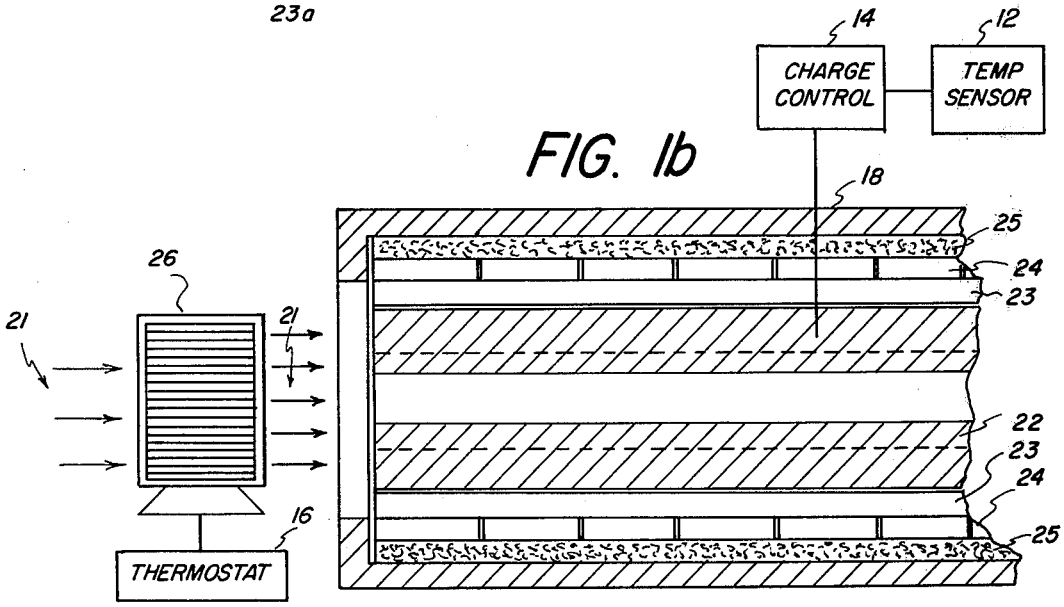

FIGS. 1A and 1B of the drawing show an electric heater 10 generally comprising outdoor temperature sensor 12, a heat charge control unit 14, a thermostat 16, a fan 26 and a heat storage unit 18. During off-peak rate time periods, the outdoor temperature sensor 12 and the heat charge control unit 14, which can be adjusted either manually or automatically to prevailing weather conditions, regulate the flow of electricity to the heat storage unit 18. The heat storage unit converts the electrical energy to heat by means of a resistance wire 20, for example, a Nichrome wire made of 80% nickel and 20% chromium. The wire 20 is wound around a ceramic heat storage pipe 22, which is supported by a ceramic cradle 23 comprising two hemispherically shaped portions 23*a* and 23*b* located in an air passageway 21 provided in the unit 18. The cradle 23 is surrounded by inexpensive magnesia bricks 24 which greatly increases the heat storage capability of the unit. The heat generated by the wire 20 is transferred to and stored in the ceramic pipe, cradle, and bricks. Although the internal temperature of the ceramic can be as high as 1200 degrees Fahrenheit (F.), thermal insulation 25 surrounding the cradle 23 maintains the exterior surface of the unit 18 below 140° F. at all times. During peak rate time periods, the heat is withdrawn from the pipe 22, cradle 23 and bricks 24 by circulating room air around and through the pipe. The air circulation is achieved by a quiet, low energy, squirrel cage fan 26 located in the air passageway near the input 21.

Referring now to FIGS. 2B and 3B, it can be seen that the ceramic pipe 22 has a scallop-shaped outer surface 28. The interior surface of the pipe may be cylindrical, as indicated by reference numeral 30 in FIG. 3B. Preferably, however, the interior surface has a plurality of internal ribs 32, as shown in FIG. 2B. The ribs 32, which are of at least two differet lengths in order to provide closer packing, provide support to the pipe 22 and, more importantly, provide a large interior heat transfer surface area.

The pipes illustrated in FIGS. 2B and 3B can be readily fabricated by the extrusion process from crystalline ceramic materials such as porcelain, mullite, alumina, zirconia, zircon, cordierite, fosterite, petalite, spodumene, perovskite, steatite, magnesia, silicon carbide, silicon nitride and beryllia as well as glassy ceramic materials such as borosilicates, soda-lime, flint, plate, alumina silicate, silica (quartz) and the like. Petalite, spodumene, and cordierite are particularly useful because of their heat retention and thermal shock resistance properties. The selected ceramic material is extruded onto a moving belt (not shown), cut off at the desired length and then rolled on a multi-bladed knife (not shown) to cut a plurality of parallel grooves 34 in all of the crest portions 36 of the scallop-shaped outer surface 28 as shown in FIG. 2A. Alternatively, as shown in FIG. 3A, parallel grooves 34 can be cut in all of the crest portions 36 except one in the first operation, and, in a second operation slanting grooves 37 can connect adjacent parallel grooves.

After cutting the grooves, the ceramic pipe is fired in a furnace. The heat resistance wire 20 is then wound into grooves 34 in contact with the pipe 22. In operation, the wire 20 expands slightly as it is heated but remains in contact with the sides of the grooves providing good heat transfer efficiency from the wire to the ceramic pipe 22.

To increase the interior heat transfer area to the air when heat is removed from the unit 18, a ceramic sponge 38 can be inserted into the center of the pipe (See FIG. 2B). To make the sponge, polyurethane foam is dipped into a ceramic slurry, the excess is squeezed out, and the foam is heated in a furnace to vaporize the plastic, making a ceramic sponge of the same shape as the foam and comprising a network or randomly located, closely adjacent, ceramic filaments defining a plurality of interconnected cavities. The vaporization of the plastic takes place in the furnace at the same time the ceramic outer body is fired. To reduce the air pressure drop, provide air turbulence and to channel the air flow to the pipe surface, spiral voids 39 can be cut in the polyurethane foam prior to dipping in the ceramic slurry. To further increase the interior surface area, the ceramic sponge can be coated with high area alumina. To provide rapid heat transfer to the circulating air, the ceramic sponge can be coated with a metal having high heat conductivity such as steel, copper or aluminium. If desired the ceramic sponge can be coated with both metal and alumina.

Techniques for coating ceramics with alumina are fully described in SAE Paper 730276 (1973) and in "Dispal M, A Unique, New and Versatile Alumina For The Ceramic Industry" presented by Robert J. Butter at the 24th Pacific Coast Regional Meeting of the American Ceramic Society (Nov. 2, 1971). Techniques for plating metal on top of the ceramic or alumina are described in Robert Clyde's U.S. Pat. Nos. 3,900,646 and 3,998,758. The details of making the aforementioned ceramic sponge are set forth in U.S. Patent Application Ser. No. 937,085 filed Aug. 28, 1978, now U.S. Pat. No. 4,251,239 in the names of Robert A. Clyde and William B. Crandall, the disclosure of which is incorporated herein by reference, and the reader is referred thereto if further information is desired.

Instead of a ceramic sponge, the interior heat transfer area can be increased by inserting metal shavings 40, such as those produced on a lathe, into the center of the pipe 22 as shown in FIG. 3B. Metal shavings of steel, stainless steel, aluminium and copper have a high surface area and excellent heat condition for providing efficient and rapid heat transfer from the heat storage core to the circulating air.

The heat storage cores of the present invention provide a number of advantages. In the manufacture of the ceramic pipe 22, the scallop-shaped outer surface 28 provides two contact points which decreases the deformation of the soft ceramic during its extrusion and during the subsequent cutting operations. The scallop-shaped outer surface also allows the depth of the grooves 34 to be increased at the wide pipe diameter which contains the grooves without increasing the probability of pipe fracture. The internal ribs also assist in preventing pipe deformation and increase the interior heat transfer area. Metal shavings or a metal plated ceramic sponge provide rapid heat transfer to the circulating air.

For a small home heater, the cradle 23 or brickes 24 would not be used. Air would be blown around the outside of the scallops as well as through the inside. As described previously, heat transfer to air from wire is poor, as is the case with most home heaters and when they are turned off, there is essentialy no heat dissipated. Our embodiment provides more even heat release, and when the fan is turned on, there is much more area exposed so heat transfer to air is much better. A further embodiment is to have insulation or a reflector around the outside scallops and blow air only through the middle of the core.

The invention has been described in detail with particular reference to preferred embodiments thereof, but it will be obvious to those skilled in the art that various changes and modifications may be made therein without detracting from the invention, and the invention is, therefore, intended to cover all such changes and modifications as fall within the true spirit and scope of the appended claims.

We claim:

1. In an electric heat storage apparatus having (1) an electric heating element, (2) a heat storage core, (3) an air passageway in communication with the core, and (4)

thermostatically controlled air circulation means, the improvement wherein said heat storage core comprises a ceramic pipe having a scallop-shaped outer surface providing a plurality of crests and troughs and a series of parallel grooves cut in at least some of the crests, and said heating element is located in said grooves in contact with said pipe.

2. The improvement according to claim 1 wherein said heating element comprises a continuous length of resistance wire wound in said grooves with said troughs providing cross-over connections from one groove to an adjacent groove.

3. The improvement according to claim 1 wherein parallel grooves are cut in all of said crests except one and slanting grooves are cut in the remaining crest that connect adjacent parallel grooves.

4. The improvement according to claim 1 wherein said pipe is a material selected from the group consisting of petalite, spodumene, or cordierite.

5. The improvement according to claim 1 wherein a ceramic sponge is located in the core of said pipe, said sponge comprising a network of randomly located, closely adjacent ceramic filaments defining a plurality of interconnected cavities.

6. The improvement according to claim 5 wherein said ceramic sponge has a plurality of internal voids.

7. The improvement according to claim 5 wherein said ceramic sponge is coated with a metal.

8. The improvement according to claim 5 wherein said ceramic sponge is coated with alumina.

9. The improvement according to claim 1 wherein metal shavings are located in the core of the pipe.

10. An electric heat storage apparatus comprising:

(a) a housing having an air passageway;

(b) a ceramic pipe located in said housing in communication with said passageway, said pipe having a scallop-shaped outer surface providing a plurality of crests and troughs, (2) a plurality of internal ribs on it interior surface, and (3) a series of parallel grooves cut in at least some of said crests; and (c) a resistance wire located in said grooves in contact with said pipe.

11. The apparatus according to claim 10 wherein said internal ribs are of at least two different lengths.

12. The apparatus according to claim 10 wherein said pipe is a material selected from the group consisting of petalite, spodumene, or cordierite.

13. The apparatus according to claim 10 further comprising a ceramic sponge located in the core of said pipe, said sponge comprising a network of randomly located, closely adjacent ceramic filaments defining a plurality of interconnected cavities.

14. The apparatus according to claim 13 wherein said sponge has a plurality of spiral voids.

15. The apparatus according to claim 13 wherein said sponge is coated with a metal.

16. The apparatus according to claim 13 wherein said sponge is coated with alumina.

17. The apparatus according to claim 10 further comprising metal shavings located in the core of said pipe.

18. The apparatus according to claim 10 further comprising a ceramic cradle supporting said pipe in said air passageway.

* * * * *